US009689650B2

(12) United States Patent
Vainshtein et al.

(10) Patent No.: US 9,689,650 B2
(45) Date of Patent: Jun. 27, 2017

(54) WING DEPLOYMENT MECHANISM

(71) Applicant: RAFAEL ADVANCED DEFENSE SYSTEMS LTD., Haifa (IL)

(72) Inventors: Alexander Vainshtein, Haifa (IL); Alexey Bouhryakov, Kiryat Ata (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 14/653,129

(22) PCT Filed: Dec. 11, 2013

(86) PCT No.: PCT/IL2013/051022
§ 371 (c)(1),
(2) Date: Jun. 17, 2015

(87) PCT Pub. No.: WO2014/097292
PCT Pub. Date: Jun. 26, 2014

(65) Prior Publication Data

US 2015/0338200 A1 Nov. 26, 2015

(30) Foreign Application Priority Data

Dec. 18, 2012 (IL) ..... 223705

(51) Int. Cl.
*F42B 15/01* (2006.01)
*F42B 15/10* (2006.01)
(Continued)

(52) U.S. Cl.
CPC ..... *F42B 15/01* (2013.01); *F42B 10/14* (2013.01); *F42B 10/38* (2013.01); *F42B 15/10* (2013.01)

(58) Field of Classification Search
CPC ..... F42B 15/01; F42B 15/10; F42B 10/14; F42B 10/38
See application file for complete search history.

(56) References Cited

U.S. PATENT DOCUMENTS 1,376,785 A 5/1921 Sellmer
4,262,862 A 4/1981 Huetter
(Continued)

FOREIGN PATENT DOCUMENTS

AU 584637 6/1989
CN 101049858 10/2007
(Continued)

*Primary Examiner* — Justin Benedik
(74) *Attorney, Agent, or Firm* — Rodney J. Fuller; Booth Udall Fuller, PLC

(57) ABSTRACT

Wing deployment mechanism for deploying a pair of wings from an airborne body, wherein their deployment in motion, each one around an axis, defines the wings' deployment plane relative to the airborne body, and wherein the mechanism is characterized by that it comprises a propelable assembly mounted in the airborne body and suited to a rotational motion around an axis that is substantially orthogonal in its direction to the wings' deployment plane, a pair of arms that are linked, each one, on its one side to the assembly and at distance from the assembly's rotation axis, and on its other side to an end of one of the wings and at a distance from the axis around which the rotational motion of the wing in the wings' deployment plane is enabled, and wherein the link of each one of the arms is performed in a manner that enables angular motion of each of the arms relative to the assembly and to the end of the wing unto which it is linked, and wherein propelling the assembly to rotational motion and actuating a momentum for turning the wing as a result by the arm that is connected to it bring about concurrent rotational motion of the pair of wings in opposing directions and to their deployment on the wings' deployment plane, a method for deploying a pair of wings from an airborne body that is implementable in such mechanism and an airborne body equipped with such mechanism.

18 Claims, 9 Drawing Sheets

Figure 1:
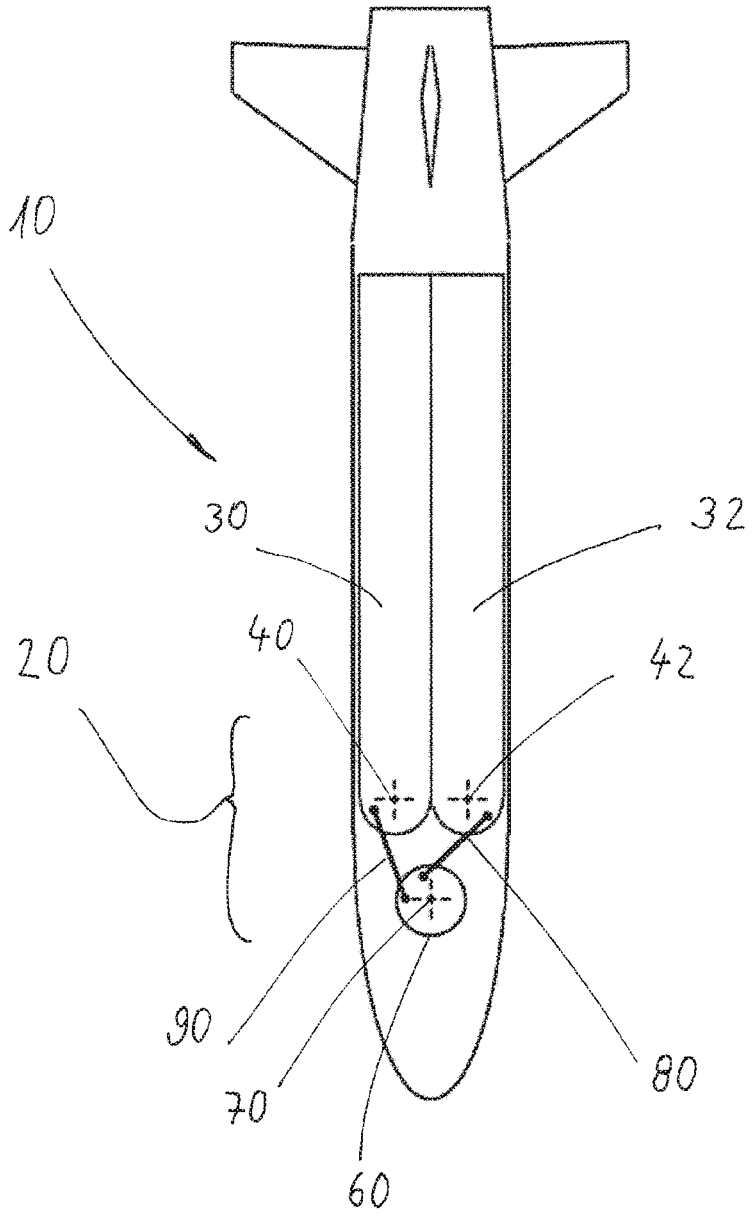

(51) Int. Cl.
*F42B 10/14* (2006.01)
*F42B 10/38* (2006.01)

(56) References Cited

U.S. PATENT DOCUMENTS

| | | | | | |
|---|---|---|---|---|---|
| 4,709,878 | A | | 12/1987 | Titley | |
| 5,141,175 | A | * | 8/1992 | Harris | F42B 10/14 102/384 |
| 5,671,899 | A | * | 9/1997 | Nicholas | B64C 3/40 244/3.28 |
| 6,758,435 | B2 | * | 7/2004 | Niemeyer | F42B 10/14 244/3.24 |
| 7,185,847 | B1 | * | 3/2007 | Bouchard | F42B 10/12 244/3.28 |
| 2004/0195436 | A1 | | 10/2004 | Sinclair | |
| 2005/0269447 | A1 | | 12/2005 | Chronister | |
| 2007/0210207 | A1 | | 9/2007 | Liao | |
| 2007/0262194 | A1 | * | 11/2007 | Agrawal | B64C 33/02 244/11 |
| 2010/0264260 | A1 | * | 10/2010 | Hammerquist | B64C 3/56 244/49 |

FOREIGN PATENT DOCUMENTS

| | | | |
|---|---|---|---|
| CN | 102121512 | | 7/2011 |
| CN | 102211665 | * | 10/2011 |
| GB | 383031 | | 11/1932 |
| GB | 790540 | | 2/1958 |
| WO | 2012112816 | | 8/2012 |

* cited by examiner

WING DEPLOYMENT MECHANISM

CROSS-REFERENCE TO RELATED APPLICATIONS

This application is the U.S. National Stage of International Application No. PCT/IL2013/051022, filed Dec. 11, 2013, which claims the benefit of and priority to Israeli Application No. 223705, filed Dec. 18, 2012, the contents of each of which are hereby incorporated by reference in their entireties.

FIELD OF THE INVENTION

The invention, the subject matter of this application, is found in the field of mechanisms that serve to deploy wings from airborne bodies, for example—deploying wings from a precision-guided munition, of the type of an airborne launched gliding bomb, where in its tied state (when it is connected to the airplane) its wings are folded and they spread only after it is dropped from the airplane, or to deploying (spreading) the wings of a cruise missile after it is launched.

BACKGROUND OF THE INVENTION

As an example for an airborne body we will treat precision-guided munitions (PGM, smart weapon, smart munition). The operational requirement for increasing the stand off range in which it is feasible to launch a precision-guided munition from diverse platforms (aerial, land or maritime), compels attaining improved aerodynamics performance (execution) of the armament (more lift).

Implementing relatively large wings on the precision-guided munition and as an integral part of it, for attaining added lift over extended periods, is a known and recognized solution to this requirement.

Concurrently, there exists a requirement of using compact and volume saving packaging of such armament. For example—in order to enable an aerial platform, such as a fighter (combat plane) to carry a large and varied number of armaments crowded together while decreasing the aerial aerodynamic drag caused by carrying all of them on its top, or in order to enable inserting the armament into a canister that enables both storing and launching the armament in and from it, that is relatively small in its dimensions and thus enables to install several canisters one close alongside the other in a configuration of a "beehive" on top of a single launcher (that serves to launch the armaments from the canisters wherein the launcher is installed on a platform of whichever type).

Folding the wings along or on the sides of the armament and the deployment of the wings only after dropping or launching the armament, is a recognized technique for coping with this requirement.

Thus, in the period (epoch) that preceded the invention that is the subject matter of this application there were many publications that describe various mechanisms for deploying a pair of wings from airborne bodies, wherein in the folded state, before deployment, the wings are located one on the side of the other (in a tandem configuration) or one above the other, alongside the airborne body, and in the deployed state the pair of wings is propelled for being deployed on a plane (herein after the wing's deployment plane). See for example—U.S. Pat. No. 5,141,175, U.S. Pat. No. 5,671,899, U.S. Pat. No. 6,758,435, U.S. Pat. No. 7,185,847.

In the variety of known and recognized mechanisms for deploying a pair of wings as said, there exists one or more of the following drawbacks (disadvantages): non-efficient transmission function that detracts from the kinetic efficiency of the mechanism (the opening momentum can not be adapted to the varying load that prevails on the wings along their deployment path), inability of the wings deployment mechanism to cope and to provide an answer (a solution) to the requirement to divert and to vary the angle of attack of the wings (for example when it refers to a mechanism that is based on a cogwheels transmission), lack of ability to compensate for differences in loads that are exerted on the wings during the deployment cycle, structural complications that harm the possibility of low priced manufacturing and relatively simple assembling of the mechanism, or that the mechanism needs a complex and meticulous limited packaging design for enabling its integration in the airborne body.

Thus, in the period that preceded the invention that is the subject matter of this application, there existed a need for at least a mechanism for deploying a pair of wings from an airborne body, that would be simple and of relatively low cost for manufacturing and assembling, enable its generic installation on a variety of airborne bodies, without imposing meticulous packaging requirements, maintain an effective transmission function relatively to the loads that are exerted on the wings and given to be used also for deploying wings that vary their angle of attack.

SUMMARY OF THE INVENTION

The current invention, the subject matter of this patent application, responds to the need expressed above by providing a mechanism for deploying a pair of wings from the body of an airborne body (for example—from a gliding bomb), wherein in similarity to existing mechanisms, the deployment of the wings' pair that is performed in their motion, of each one around its axis, defines the wings' deployment plane relative to the airborne body.

A mechanism in accordance with the invention is characterized by that it comprises a propelling assembly that is installed in the airborne body and adapted to a rotational axis that is substantially perpendicular (orthogonal) in its direction to the wings' deployment plane. A pair of arms, each one of them linked on its one side to the propelling assembly and at a distance from the rotation axis of the assembly, and on its other side to an end of one of the wings and at a distance from the axis around which the rotational motion of the wing is enabled on the wings' deployment plane. Linking each one of the arms is made in a manner that enables angular motion of each one of the arms relative to the assembly and to the end of the wing unto which it is connected. The propelling of the assembly to a rotational movement and actuating a moment to rotating the wing as its result, by the arm unto which it is connected to, leads to a simultaneous rotational movement of the pair of wings in opposing directions, and to their deployment on (over) the wings' deployment plane.

In an other and different aspect of the invention, in the operation way of a mechanism in accordance with the invention there is embodied a general method for deploying a pair of wings from an airborne body, wherein each one of the of the wings is spreadable through moving (revolving) around an axis on a wings' deployment plane relative to the airborne body.

A method that comprises the steps of—positioning a rotatable assembly at a distance from the axis of each of the wings and in a manner that its rotation axis is substantially parallel to each one of the wings; harnessing an end of each one of the wings at a distance from its (rotation) axis unto the rotatable assembly at a distance from its rotation axis using arms and in a manner that enables angular motion of each arm relative to the rotatable assembly and to the end of the wing unto which it is connected; and propelling the rotatable assembly to a rotational motion in a manner that it actuates a momentum for revolving the wings around their axis, in opposing directions, and to their deployment on (over) the wings' deployment plane.

In other and additional aspects of the invention, it embodies in any airborne body (for example—a gliding bomb, cruise missile, unmanned aerial vehicle), that has a pair of wings that are deployable in motion—each one around its respective axis on said wings deployment plane relative to the airborne body, wherein the means for deploying the wings is a mechanism as said in accordance with the invention, or by a mechanism that implements in its operation the said general method.

It is to be understood that both the foregoing general description and the following detailed description are solely exemplary and explanatory and are intended to provide further explanations of the invention as claimed.

BRIEF DESCRIPTION OF THE ACCOMPANYING DRAWINGS

Examples illustrative of embodiments of the invention are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale.

Figure 2:
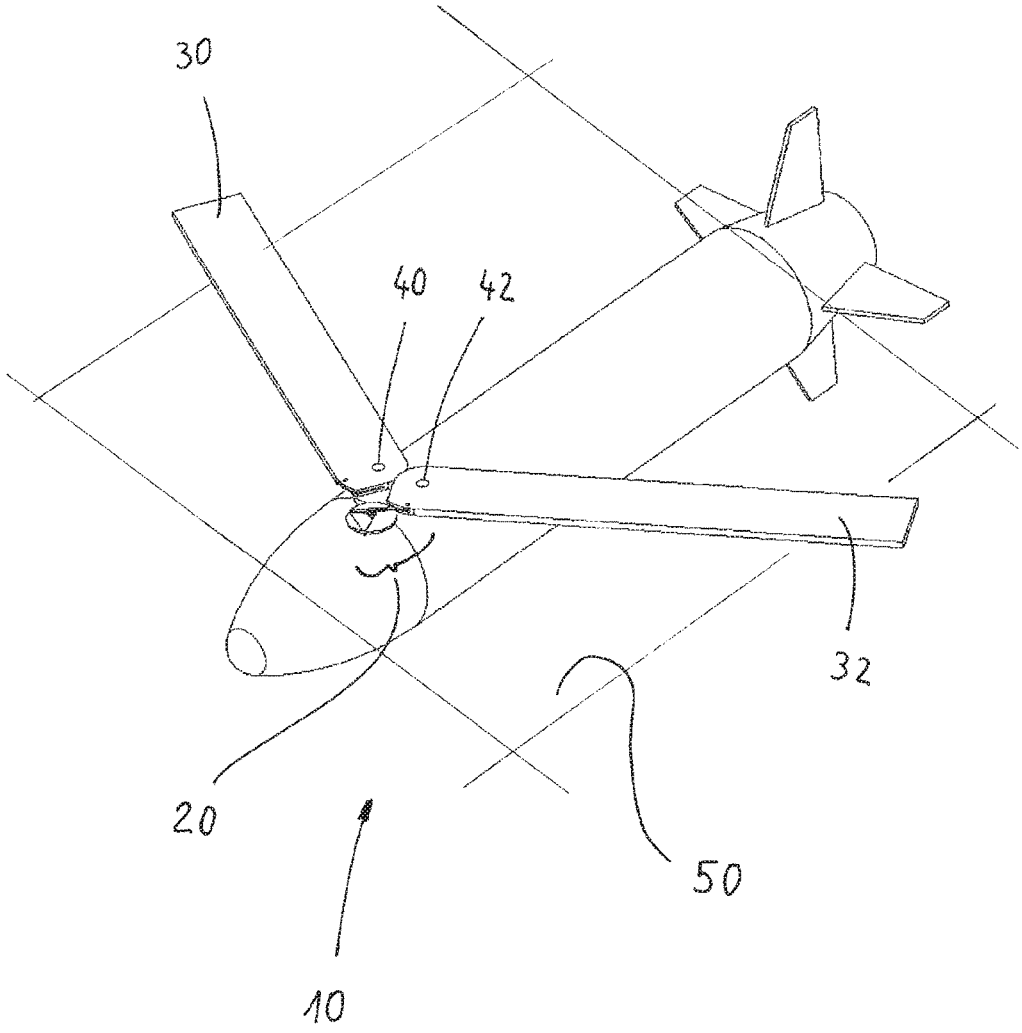

FIGS. 1 and 2 constitute schematic drawings of an airborne body (in the illustrated example—a gliding bomb) in which a mechanism in accordance with the invention is mounted, wherein the wings are illustrated (respectively)—in a folded state (view from above) and in the deployed state (a view in perspective).

Figure 3:
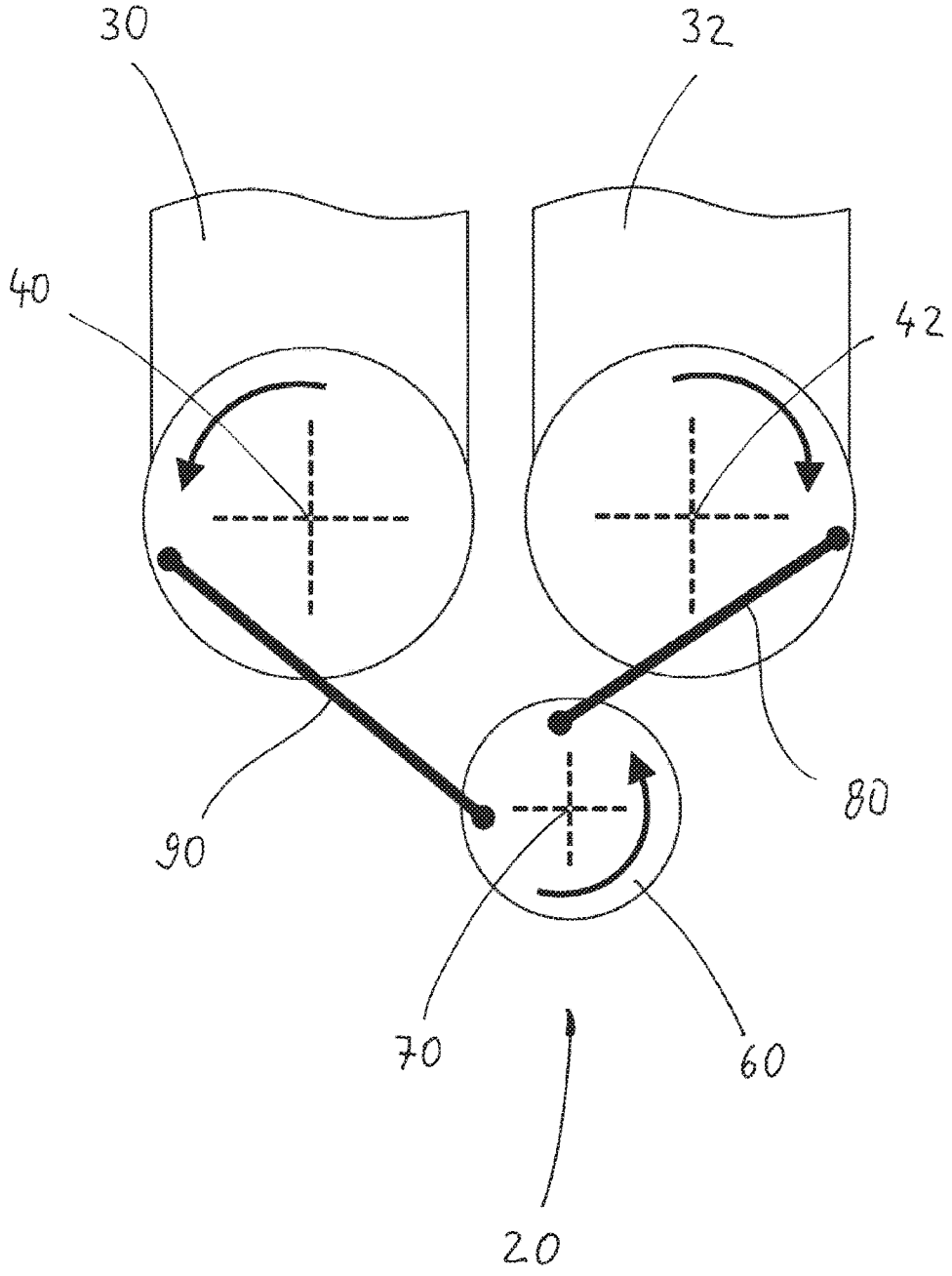
Figure 4:
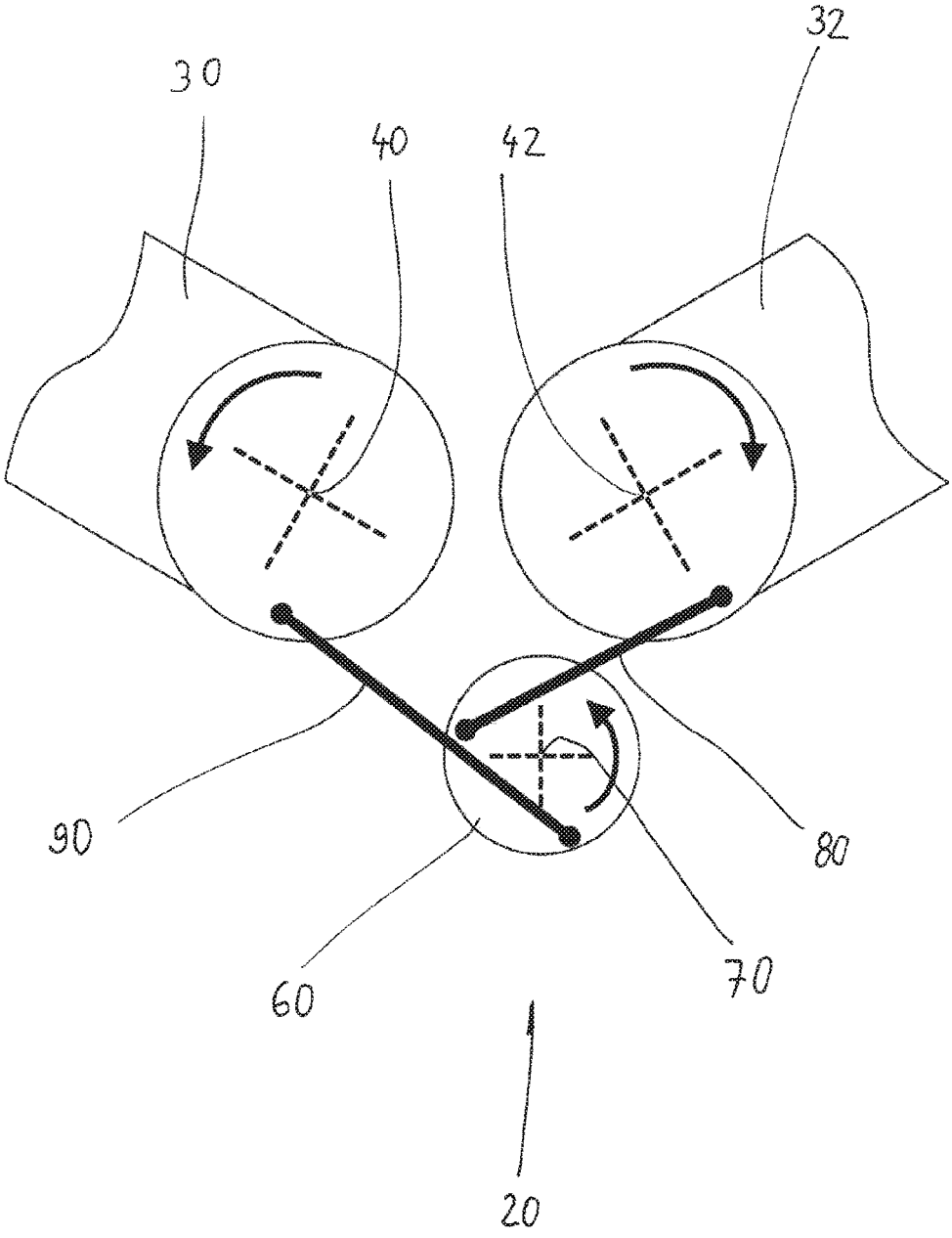

FIGS. 3 and 4 constitute schematic drawings that present the operation principle of the mechanism that is installed in the airborne body that was illustrated in FIGS. 1 and 2, wherein the mechanism is illustrated in the state preceding the deployment of the wings and when the deployment of the wings was completed—respectively.

Figure 5:
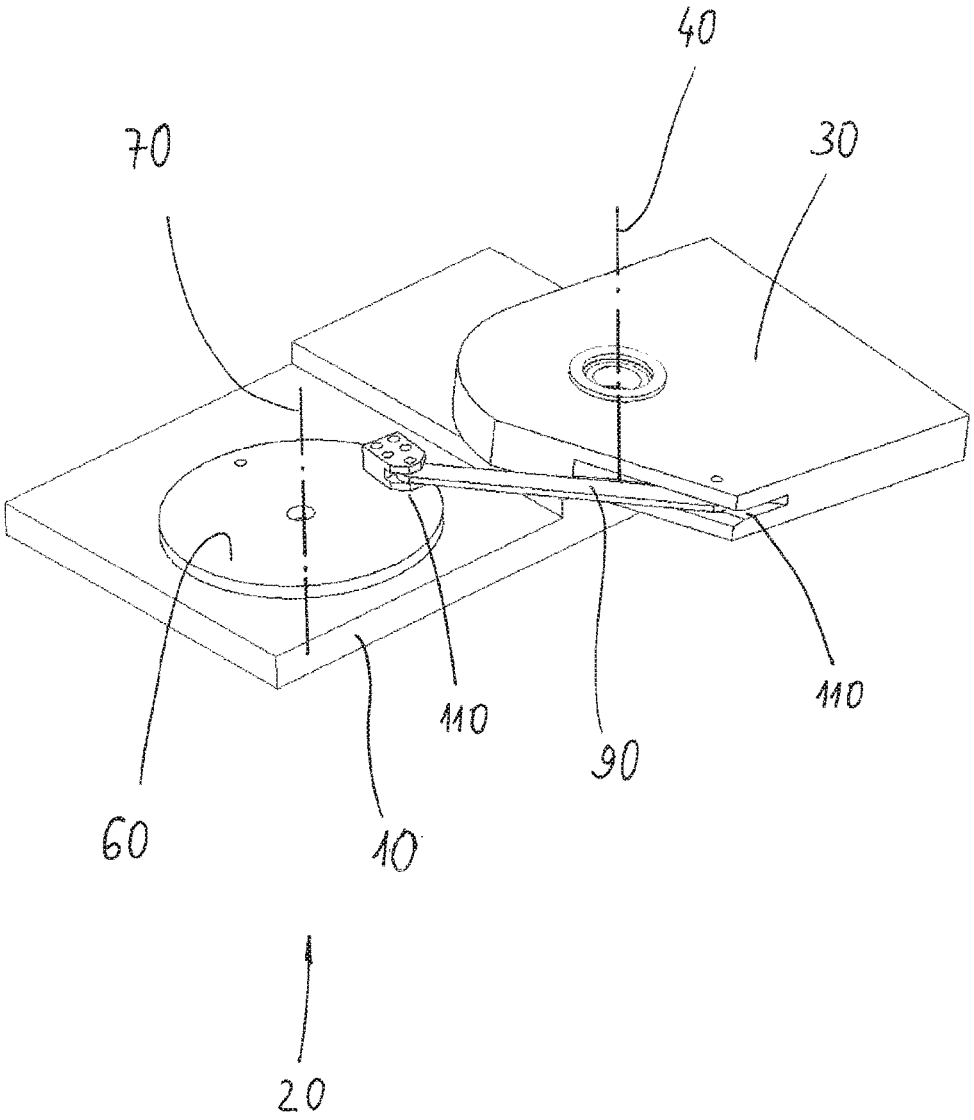

FIG. 5 constitutes a partial view in perspective of a characteristic arm in a mechanism in accordance with the invention and depicts the manner of its connection at one end of it to a rotating assembly and at its other end to an end of a wing.

Figure 6:
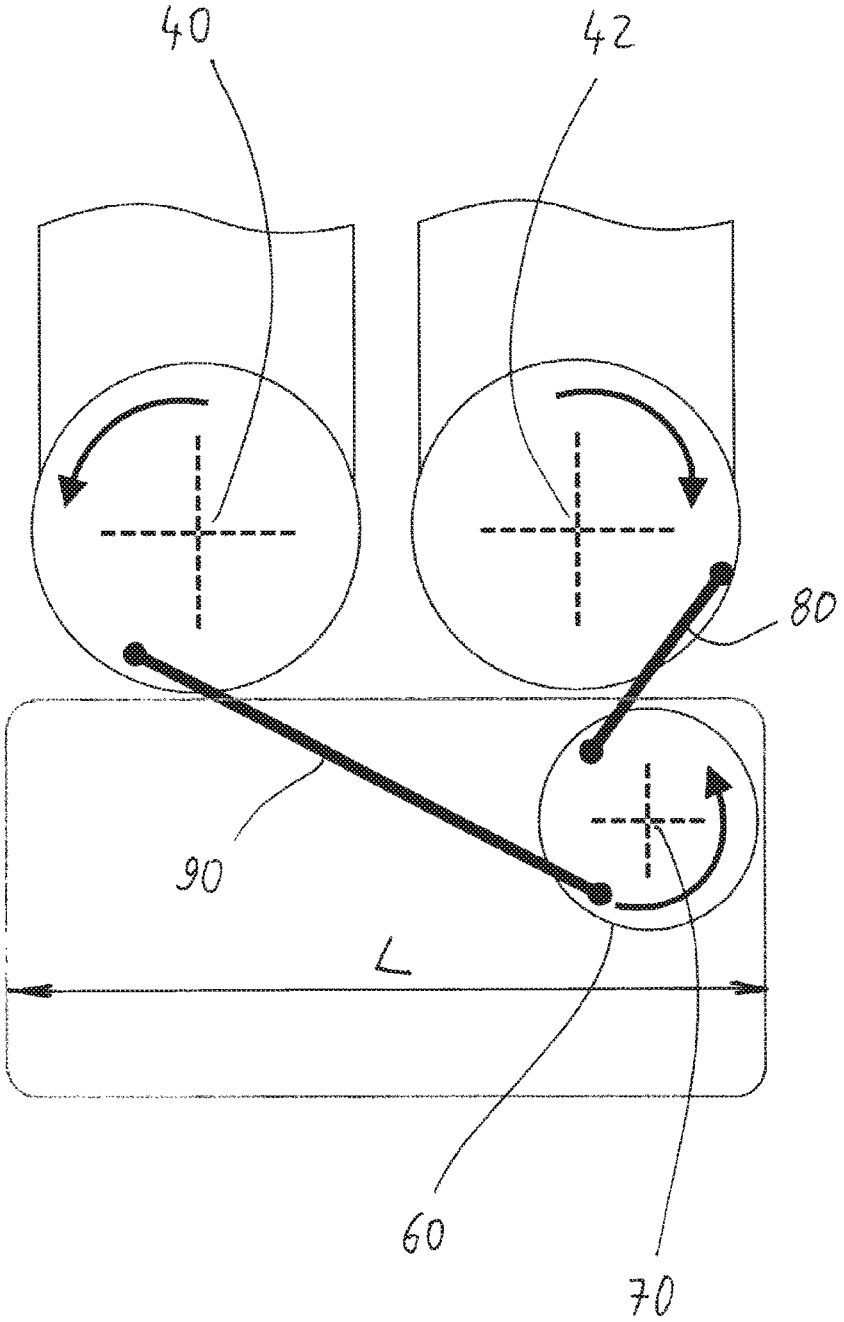

FIG. 6 constitutes a schematic drawing that presents a feasible packaging configuration of a mechanism in accordance with the invention wherein the rotation axis of the rotating assembly is located along one of the two axes of the wings (and not necessarily between them).

Figure 7:
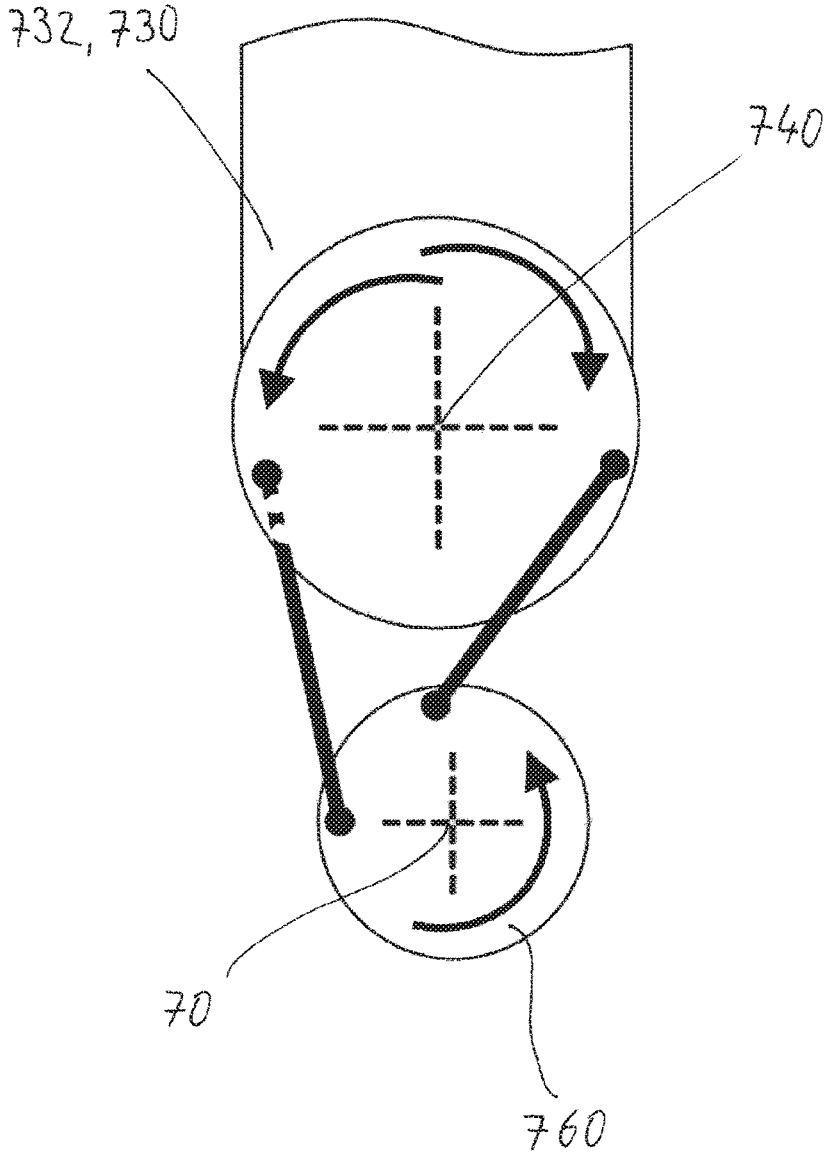

FIG. 7 constitutes a schematic drawing that presents an additional feasible packaging configuration of a pair of wings that are also given to be deployed with a mechanism in accordance with the invention (the two wings are installed one on the other).

Figure 8:
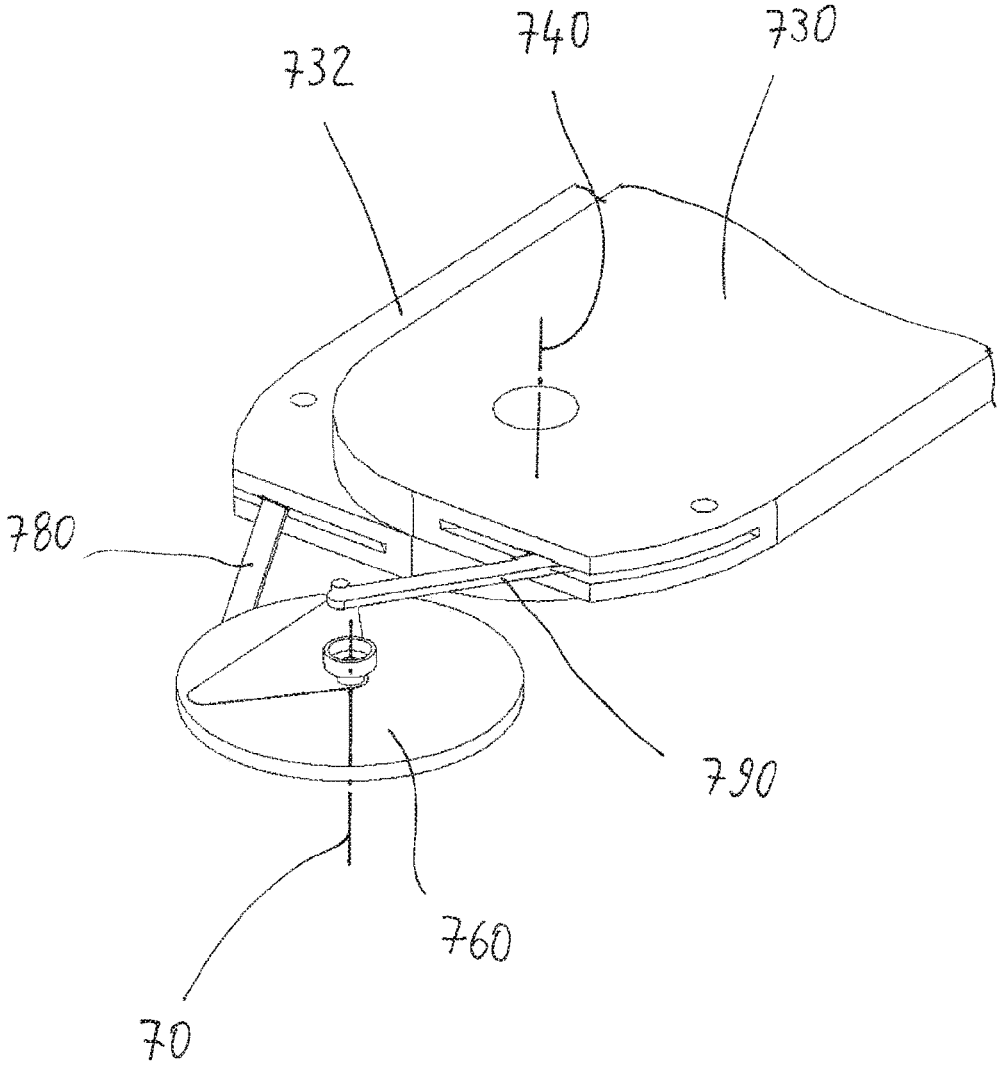

FIG. 8 constitutes a partial view in perspective of the configuration of two wings embodied "one on the other", that was illustrated schematically in FIG. 7.

Figure 9:
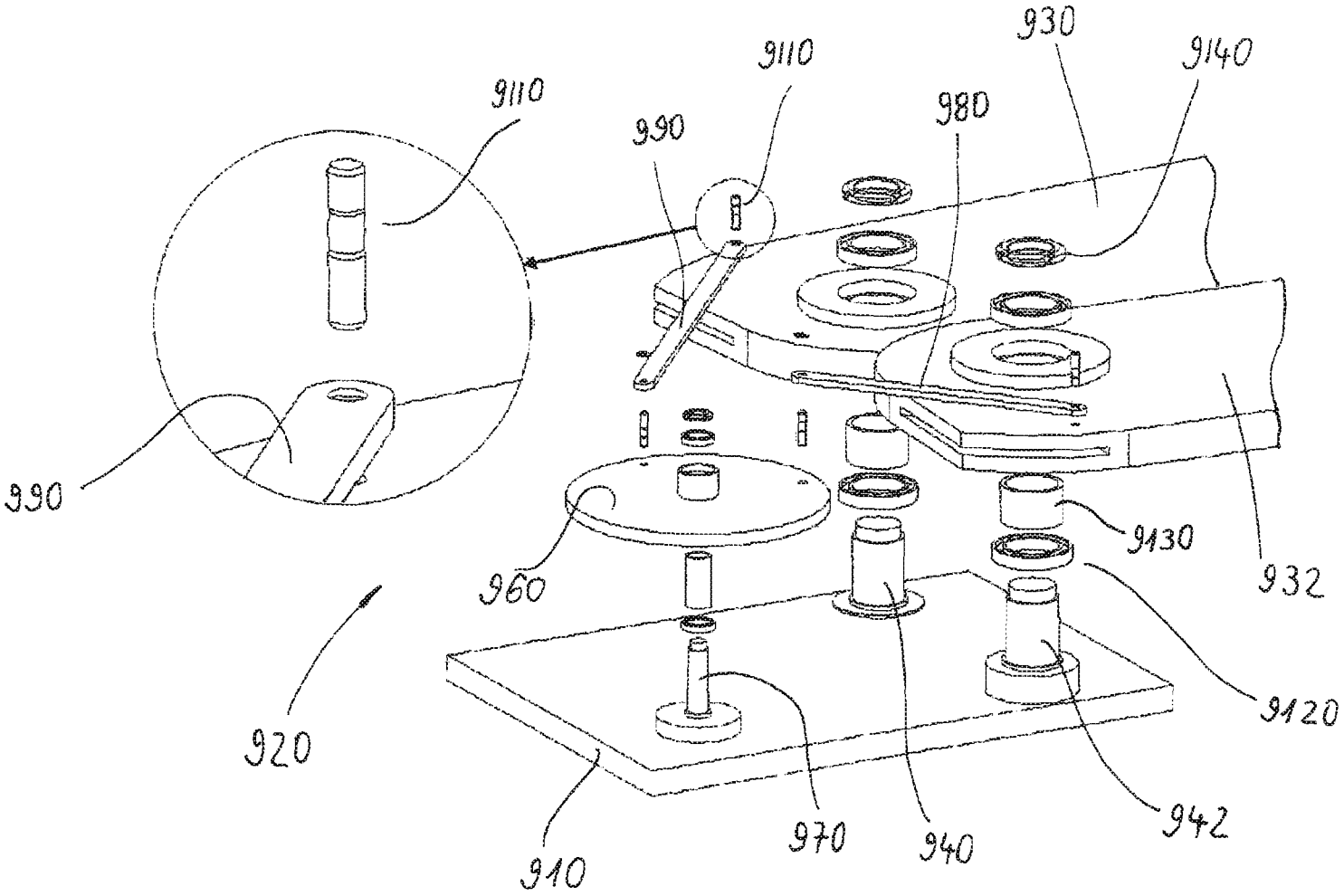

FIG. 9 constitutes an exploded view of the components of an example of a mechanism in accordance with the invention.

DETAILED DESCRIPTION OF AN EXAMPLE EMBODIMENT OF THE INVENTION

Reference is made to FIGS. 1 to 4. FIGS. 1 and 2 are schematic drawings of an airborne body 10 (in the illustrated example—a gliding bomb) in which mechanism 20 is installed in accordance with the invention, wherein the wings 30 and 32 are illustrated in their folded state (FIG. 1) and in the deployed state (in perspective—FIG. 2). FIGS. 3 and 4 constitute schematic drawings that present the operation principle of mechanism 20 that is installed in airborne body 10, wherein the mechanism is illustrated in the state preceding the deployment of the wings (FIG. 3) and when the deployment of the wings was completed (FIG. 4).

Mechanism 20 is illustrated wherein it serves for deploying a pair of wings 30 and 32 from airborne body 10 that in the illustrated example is, as said, a gliding bomb, but any professional would understand that we are referring solely to an example and that the mechanism is applicable to any airborne body that requires deployment (spreading) a pair of wings as said (and see the "Background of the Invention" chapter), (for example a cruise missile or a UAV).

The deployment of the wings is executed in a rotational movement around axes 40, 42 and defines the wings' deployment plane 50 (see FIG. 2) relative to the airborne body. Any professional would understand that the definition of plane 50 is done for providing clarifications and for separating the mechanism that we are presenting from other mechanisms used for deploying a circumferential array of wings. Plane 50 might also have a height dimension, for example as the pair of wings are being deployed while at the same time altering their angle or when they are installed in different planes, one above the other.

Mechanism 20 is characterized by that that it includes an assembly 60 that can be propelled mounted in the body of the airborne body and adapted to rotational motion around axis 70 that is substantially perpendicular in its direction to the wings' deployment plane 50.

Propelling the central rotational element, assembly 60, for rotational motion as said, might be executed (performed) by a means (that is not illustrated) that was selected from a group that might consist of an electro-mechanic actuator (for example—an electrical motor and a cog wheels transmission), a pneumatic means, pyrotechnics or a rotational gas piston.

A pair of arms 80, 90 are linked, each one of them on its one side, to an assembly 60 that can be propelled and at a distance from the rotation axis 70 of the assembly, and on its second side to an end of one of wings 30, 32 and at a distance from axes 40, 42 (respectively) around which the rotational movement of the wings on the wings' deployment plane 50 is enabled.

Connecting (linking) each one of the pair of arms 80, 90 is done in a manner that enables angular movement of each one of the arms relative to assembly 60 and to the end of wings 30, 32 unto which it is linked. In other words, we talk about an axial linking that enables relative angular movements between the components.

Any professional would understand that rotational movement of the central element (assembly 60) enables the rotational movement of the wings around their (suiting) axes. Propelling assembly 60 into a rotational movement thus leads to actuating a rotation moment for rotating the wings, each wing by the arm that is connected to it, and leads to concurrent rotational movement of the pair of wings in opposing directions, and to their deployment on the wings' deployment plane 50.

Any professional would also understand that a mechanism in accordance with the invention enables compensating for the differences in the loads that prevail on the wings. The moment that assembly 60 exerts at any given minute has to be the sum (accumulation) of the moments that have to be actuated at that given minute for propelling each one of the wings and hence it is not influenced by the difference (if it exists) between the moments that have to be exerted on each wing.

A mechanism in accordance with the invention enables production of a variable transmission function that can be suited to the varying loads on the wings in a manner that increases the kinetic efficiency of assembly 60. Let's assume that propelling assembly 60 into a rotational motion is executed by an electrical motor means. As a rule, in mechanisms for deploying a pair of wings, when an electrical motor means is meant to supply the energy required for deploying the wings, then naturally if the maximum moment of the motor is limited and as the used motor would be smaller, so would the maximum moment that can be produced from it would be (accordingly) smaller. For producing a maximal moment as required for deploying a pair of wings, it is mandatory to select a relatively large motor or one that has a large transmission ratio. Two options that result in reduced efficiency at low momentums and to render limitations of speed at times of deploying the wings. In contra-distinction, a mechanism in accordance with the invention enables to produce a variable transmission function that would be suited to the load. A transmission function that enables to drastically reduce the momentum on assembly 60 and to decrease the difference between the maximal momentums to the minimal momentum that the revolving assembly 60 is required to cope with. Hence, in a mechanism in accordance with the invention, it is possible to select a relatively small motor with relatively smaller transmission ratio. Thus a small and efficient propelling system (from the kinetic point of view) is achieved.

Reference is made to FIG. 5. FIG. 5 constitutes a partial view in perspective of a characteristic arm 90 in mechanism 20, and the manner of its connection at one end of it to a rotating assembly 60 and at its other end to an end of a wing 30.

Arm 90 (similarly to arm 80) can have on the spot means for varying and suiting its length (that is not illustrated). Any professional is familiar with similar arms that are routinely used in airborne bodies, for example for operating flaps and ailerons.

Spherical joint means 110 are embodied at the ends of each one of the arms, in a manner that turnings (diversions) and varying the angle of attack of the wings can be made concurrently with their deployment and should not detract from (nor harm) the angular mobility capability of the arms from the instant that they were connected as said, each one of them to one end of assembly 60 and on the other end to a an end of a wing.

Thus, any professional would appreciate the fact that turning or diverting the axes of wings 40, 42 for changing the angle of attack of the wings during the time they are being deployed, or of axis 70 or of all the axes in the system, is liable to not influence the functioning of a mechanism in accordance with the invention (as long as the angles changes are "swallowed" by the spherical joint means and hence a rotational movement is enabled as said).

In the configuration of implementing a mechanism in accordance with the invention that is illustrated in FIGS. 1 to 5, each one of the wings has its own axis (i. e., 40, 42) that around it the rotational movement of the wing would take place, as said. The axes are positioned in parallel one to the other, at a distance from rotation axis 70 of said assembly and substantially orthogonal in their direction to the wings' deployment plane 50 (as said above, the limitation of the capability of the spherical joint means to absorb the differences in the axis' angles is what establishes the measure of the allowed deviation of the angles of the axis).

In the configuration of implementing a mechanism in accordance with the invention that is illustrated in FIGS. 1 to 5, the rotation axis 70 of assembly 60 is located between the two axes 40, 42 of the wings, in a manner that—apparently, dictates packaging limits to assembly 60.

However, any professional would appreciate the fact that assembly 60 might also be packaged in another and different configuration.

Reference is made to FIG. 6. FIG. 6 constitutes a schematic drawing that presents a feasible packaging configuration of a mechanism in accordance with the invention—wherein the rotation axis 70 of rotating assembly 60 is located along one of the two axes 40, 42 of the wings (and not necessarily in any position between them, as illustrated in the implementation embodiment depicted in FIGS. 1 to 5).

Thus, any professional would appreciate the fact that positioning rotation axis 70 of assembly 60 along the side of one of the two axis 40, 42 of the wings, necessitates solely a change in the relative length of arms 80, 90, but at the same time, provide for design flexibility of all that is connected to the selectable positioning of the most dominant component from the aspect of volume in the mechanism—the propelling means of assembly 60 and even enables its angular inclination.

For example, laying down an electrical motor (that is not illustrated) along the entire breadth of the airborne body (crosswise) (see dimension L in the figure) and affecting inclination of the rotation axis by 90° using an appropriate (suiting) transmission, for obtaining axis 70. Another option—it is viable to package an electrical motor so that its propelling axis would be parallel to axis 70 and connected to it by an appropriate (suiting) transmission.

In other words, in accordance with the invention, it is viable to position the central revolving element (assembly 60) anywhere in the zone marked by dimension L in accordance with the optimal packaging of the rest of the propelling components (for example—the schematic drawing depicts positioning of the revolving assembly on the side and in a manner that it leaves volume for packaging its propelling components (that are not illustrated)).

In the configurations of implementation and packaging the mechanisms in accordance with the invention that are illustrated in FIGS. 1 to 6, the pair of wings are positioned one on the side of the other (in tandem), and at most with differences of height one from the other, in a manner that on the face of it dictates packaging restrictions. However, any professional would appreciate the fact that a mechanism in accordance with the invention is viable to deploy a pair of wings also when they are packaged in another and different configuration.

Reference is made to FIGS. 7 and 8. FIG. 7 constitutes a schematic drawing that presents an additional feasible packaging configuration of a pair of wings 730, 732 that are also given to be deployed by a mechanism in accordance with the invention wherein the two wings are installed one on the other (namely in a configuration of 'floors' ('stories') to differentiate it from the 'tandem'). FIG. 8 constitutes a partial view in perspective of the two wings 730, 732 configuration wherein they are mounted one on the other.

The two wings are mounted one on the other in a "two stories" structure, with one common axis 740 around which would be carried out, as said, the rotational movement of the wings. Axis 740 is positioned at a distance from rotation axis 70 of assembly 760 where it is substantially orthogonal in its direction to the wings' deployment (where as said, the limitation of the capability of the spherical joint means mounted at the ends of the arms to absorb the differences in the angles of the axis are what determines the measure of the allowed deviation in the angles of the axis).

A pair of arms 780, 790 are connected, each one from its one side to an assembly 760 that can be propelled and at a distance from the rotation axis 70 of the assembly (the end of each arm to the other side of the revolving assembly), and from its other side to an end of one of the wings 730, 732 (in different planes one from the other), at a distance from the common axis 740 of the two wings around which the rotational movement of the wings is enabled.

Linking of each one of the two arms 780, 790 is made in a manner that enables angular movement of each one of the arms relative to assembly 760 and the end of wings 730, 732 unto which it is connected (see the openings formed in each one of the wings). In other words, the discussed subject is the axial linking that enables relative angular movement between the components.

Thus, any professional would appreciate the fact that a mechanism in accordance with the invention enables flexibility in positioning and in packaging the wings. In the 'tandem' configuration—one alongside (on the side) of the other—with two separate axes at different distances, including an angular inclination between them, as also in the 'floors' ('two stories') configuration—one wing over (on top) of the other wherein they share a common axis.

Reference is made to FIG. 9. FIG. 9 constitutes an exploded view of the components of an example of a mechanism 920 in accordance with the invention. The mechanism is designated to deploy a pair of wings 930, 932 from an airborne body that is illustrated schematically as a surface (flat place) 910.

Any professional would understand that surface 910 can be an integral part from an airborne body as said or a mountable component to an airborne body as a part of an add-on kit. For example, a kit of a pair of wings and a mechanism for deploying them that is added to a body of an 'iron bomb' as part of converting it to a precision-guided munition capable of being dropped from a stand-off distance.

Mechanism 920 comprises axes 940, 942 wherein around them the deployment of the wings is being executed (in the illustrated example it is packaging a pair of wings in their folded state in the 'tandem' configuration—one alongside the other). Arms 980, 990 connect (in accordance with the invention) the wings to a revolving assembly 960. Revolving assembly 960 is connected to axis 970 in a manner that enables it to be propelled to rotational movement by propelling means that are not illustrated (for example, an electrical motor and a suitable transmission). Spherical joint means 9110 are implemented at the ends of each one of the arms, in a manner that enables absorbing angular changes between the axes of the system, all of them or just some of them of.

An array of bearings 9120, spacer bushings 9130 and locking nuts 9140 is located on each one of the axes (940, 942, 970) in the mechanism, for smooth bearing the rotational motion performed on it.

Thus, any professional would appreciate the fact that a mechanism in accordance with the invention requires mainly standard components, wherein most of them are "off the shelf" purchasable items.

Any professional would also understand that in the operation way of the mechanism in accordance with the invention as was described above when referring to the accompanying figures, there is also embodied a general method for deploying a pair of wings from an airborne body, wherein each one of the of the wings is spreadable through moving (revolving) around an axis on (over) a wings' deployment plane relative to the airborne body.

A method that comprise the steps of—positioning a rotatable assembly at a distance from the axis of each of the wings and in a manner that its rotation axis is substantially parallel to each one of the wings; harnessing an end of each one of the wings at a distance from its rotation axis unto the rotatable assembly at a distance from its rotation axis using arms and in a manner that enables angular motion of each arm relative to the rotatable assembly and to the end of the wing unto which it is connected; and propelling the rotatable assembly to a rotational motion in a manner that it actuates a momentum for revolving the wings around their axis, in opposing directions, and to their deployment over the wings' deployment plane.

In light of the description presented above that was given while referring to the accompanying figures, a logical conclusion is a mandatory outcome and accordingly, a mechanism in accordance with the invention for deploying a pair of wings from an airborne body is a rather simple and relatively low priced mechanism, easy to be manufactured and assembled, enables its generic installation on a variety of airborne bodies without posting meticulous (pedant) packaging requirements, realizes an efficient transmission function in relation to the loads on the wings and given to be used also for deploying wings that vary their angle of attack.

While the above description contains many specifications, the professional reader should not construe these as limitations on the scope of the wing deployment mechanism which is the subject matter of the invention, but merely examples of embodiments thereof. It will be apparent to those skilled in the art of designing and manufacturing such mechanisms that various modification and variations can be made in the wing deployment mechanism of the present invention without departing from the spirit or scope of the invention. Thus, it is intended that the present invention covers modifications and variations that come under the scope of the following claims and their equivalents.

The invention claimed is:

1. A mechanism for deploying a pair of wings from an airborne body, wherein deployment of the wings in motion, each wing around an axis, defines the wings' deployment plane relative to the airborne body, and wherein the mechanism comprises— an assembly that can be propelled that is mounted in said airborne body and is suited to a rotational motion around an axis that is substantially orthogonal to said wings' deployment plane, and a pair of arms that are linked, each one, on one side of each arm to said assembly that can be propelled and at distance from the rotation axis of said assembly, and on each arm's opposite side to an end of one of said wings and at a distance from said axis around which said rotational motion of the wing in the wings' deployment plane is enabled, and wherein said link of each one of the arms is performed in a manner that enables angular motion of each of the arms relative to the assembly and to said end of the wing unto which each one of the arms is linked, and wherein propelling said assembly to rotational motion and actuating a momentum for turning the wing as a result by said arm that is connected to the wing bring about concurrent rotational motion of the pair of wings in opposing directions and to deployment of the pair of wings on the wings' deployment plane.

2. A mechanism according to claim 1 wherein— a spherical joint means is implemented at ends of each of said arms, in a manner that wings' deviation and change of angle of attack in the course of deployment would not detract from said arms' angular motion capability, from an instant of each arm being connected at one end to said assembly and on the second end to a wings' end.

3. A mechanism according to claim 1 wherein— each wing has a separate axis around which wings' rotational motion would be realized as said, and said two separate axes are located in parallel one to the other, at a distance from said assembly's rotation axis and said two separate axes are substantially perpendicular to the wings' deployment plane.

4. A mechanism according to claim 3 wherein— the rotation axis of said assembly is located between the said two separate axes of the wings.

5. A mechanism according to claim 3 wherein— the rotation axis of said assembly is located alongside one of said two separate axes of the wings.

6. A mechanism according to claim 1 wherein— the two wings are mounted one above the other with a common axis around which said rotational motion of said wings would be executed, and said common axis is located at a distance from the rotation axis of the assembly and is also substantially orthogonal to said wings' deployment plane.

7. A mechanism according to claim 1 wherein— propelling said assembly to a rotational motion as said, is executed by a means that is selected from a group consisting of an electro-mechanic actuator, a pneumatic means, a pyrotechnic means or a revolving gas piston.

8. A method for deploying a pair of wings from an airborne body, wherein each wing is deployable in a rotational motion around an axis on a wings' deployment plane relative to said airborne body, the method comprising— positioning a rotatable assembly at a distance from the axis of each of the wings and in a manner that a rotation axis of the rotatable assembly is substantially orthogonal to each one of the wings; and harnessing an end of each one of the wings at a distance from the rotation axis unto the rotatable assembly at a distance from the rotation axis using arms and in a manner that enables angular motion of each arm relative to the rotatable assembly and to the end of the wing unto which each arm is connected; and propelling the rotatable assembly to a rotational motion in a manner that the rotatable assembly actuates a momentum for revolving the wings around their axis, in opposing directions, and to their deployment over said wings' deployment plane.

9. An airborne body equipped with a pair of deployable wings by motion around an axis, on a wings' deployment plane relative to said airborne body, the airborne comprising the mechanism for deployment of the wings in accordance with claim 1.

10. An airborne body equipped with a pair of deployable wings by motion around an axis, on a wings' deployment plane relative to said airborne body, and wherein the mechanism for the wings' deployment that is mounted in said airborne body implements through operation of the mechanism the method defined in claim 8.

11. A system for deploying wings from an airborne body across a deployment plane, comprising:

a first wing axis bearing adapted to rotatably couple a first wing to the airborne body at a first axis, the first wing capable of rotating around the first axis from a folded state to a deployed state by traversing the wings' deployment plane;

a second wing axis bearing adapted to rotatably couple a second wing to the airborne body at a second axis, the second wing capable of rotating around the second axis from the folded state to the deployed state by traversing the wings' deployment plane, wherein a long axis of each of the first and second wings are positioned substantially alongside the length of the airborne body in the folded state, and wherein the first and second wings are positioned outwards from the airborne body in the deployed state; and a deploying mechanism coupled to the airborne body and the first and second wings, the deploying mechanism comprising:

a rotating assembly rotatably coupled to the airborne body at a third axis, the rotating assembly having a first joint and a second joint, wherein the third axis is substantially orthogonal to the wings' deployment plane;

a first arm having a distal end portion coupled to the first wing and a proximate end portion coupled to the first joint of the rotating assembly, the first arm being a link where rotation of the rotating assembly actuates angular motion on the first wing; and a second arm having a distal end portion coupled to the second wing and a proximate end portion coupled to the second joint of the rotating assembly, the second arm being a link where rotation of the rotating assembly actuates angular motion on the second wing;

wherein the rotating assembly is configured to rotate around the third axis such that the first arm actuates outward movement of the first wing concurrently with the second arm actuating an opposite outward movement of the second wing, thereby deploying the first and second wings along the wings' deployment plane from the folded state into the deployed state.

12. The system according to claim 11 wherein:

the distal end portion of the first arm is rotatably coupled to the first wing and the proximate end portion of the first arm is rotatably coupled to the first joint;

the distal end portion of the second arm is rotatably coupled to the second wing and the proximate end portion of the second arm is rotatably coupled to the second joint, thereby deviation and change of the angle of attack of the first and second wings deploying from the folded state to the deployed state will not detract from the angular motion capability of the first and second arms.

13. The system according to claim 11, wherein:

the first axis and the second axis are positioned parallel to each other and aft of the third axis on the airborne body;

the first axis is substantially perpendicular to the wings' deployment plane; and the second axis is substantially perpendicular to the wings' deployment plane.

14. The system according to claim 13, wherein the third axis is located between and fore of the first and second axes on the airborne body.

15. The system according to claim 13, wherein the third axis is substantially aligned along the length of the airborne body with either the first axis or the second axis.

16. The system according to claim 11, wherein:

the first axis and the second axis are coaxially positioned on the airborne body;

the first and second axes are substantially perpendicular to the wings' deployment plane;

the first and second axes are aft of the third axis on the airborne body; and the first wing is mounted above the second wing.

17. The system according to claim 11, wherein the rotating assembly is rotated around the third axis by an electromechanical actuator, a pneumatic actuator, a pyrotechnic means or a revolving gas piston.

18. An airborne body equipped with a pair of deployable wings by motion around an axis, on a wings' deployment plane relative to said airborne body, the airborne body comprising the system for deploying wings in accordance with claim 11.

* * * * *